US012523059B2

(12) United States Patent
Motooka

(10) Patent No.: US 12,523,059 B2
(45) Date of Patent: Jan. 13, 2026

(54) ANCHORING SYSTEM FOR UMBRELLA

(71) Applicant: Bert Kealoha Motooka, Kihei, HI (US)

(72) Inventor: Bert Kealoha Motooka, Kihei, HI (US)

( * ) Notice: Subject to any disclaimer, the term of this patent is extended or adjusted under 35 U.S.C. 154(b) by 230 days.

(21) Appl. No.: 18/357,944

(22) Filed: Jul. 24, 2023

(65) Prior Publication Data

US 2025/0034897 A1 Jan. 30, 2025

(51) Int. Cl.
*E04H 15/62* (2006.01)
*A45B 23/00* (2006.01)

(52) U.S. Cl.
CPC ..... *E04H 15/62* (2013.01); *A45B 23/00* (2013.01); *A45B 2023/0012* (2013.01); *A45B 2200/1009* (2013.01)

(58) Field of Classification Search
CPC ..... E04H 15/60; E04H 15/62
See application file for complete search history.

(56) References Cited

U.S. PATENT DOCUMENTS 2,607,648 A * 8/1952 Metcalf ..... A47B 37/04 248/156
4,924,893 A * 5/1990 Furey ..... E05B 73/0005 70/59
5,441,064 A * 8/1995 Becker ..... A45B 25/18 2/22
6,216,998 B1 * 4/2001 Butrymowicz ..... A01K 97/10 248/530
6,267,127 B1 * 7/2001 Doreste ..... E04H 12/2215 52/165
6,487,977 B1 * 12/2002 Williams ..... E04H 12/2223 108/150
6,854,531 B2 * 2/2005 Jubinville ..... E04H 17/265 173/132
8,327,863 B1 * 12/2012 Dupree ..... A45F 5/00 248/500
9,763,501 B2 * 9/2017 Supino ..... A45B 3/00
11,613,903 B2 * 3/2023 Kelley ..... A45B 25/00 135/98
2004/0089332 A1 * 5/2004 Mandel ..... A45B 25/22 135/16
2011/0253876 A1 * 10/2011 Odell ..... E04H 12/2215 248/530
2011/0305867 A1 12/2011 Lee et al.
(Continued)

OTHER PUBLICATIONS

Summer Large Canopy Sand Bags Blue Sand Bags Weights Portable Weights for Canopy Legs Beach Umbrella Sand Bag Heavy Duty Sandbag for Tent Outdoor Instant Canopies Holiday Supplies (2 Pieces) (https://www.amazon.com/Weights-Portable-Umbrella-Canopies-Supplies/dp/B09S346V25/ref=sr_1_7?hvadid=657208735389&hvdev=c&hvlocphy=9011707&hvnet . . . ); 9 pages; retrieved May 10, 2023.

(Continued)

*Primary Examiner* — Noah Chandler Hawk
(74) *Attorney, Agent, or Firm* — Jeffrey G. Sheldon

(57) ABSTRACT

An umbrella includes a canopy, a pole, and a plurality of pouches suitable for holding grounding material. In one version of the invention, a cord for each pouch links the pouch to the canopy, and there are hook and loop fastener pairs for removable attaching each pouch to the canopy. Each pouch can have a loop for receiving a stake for staking the umbrella to a surface. The stakes can be stored in the pole, and a cap for the pole can have an integral hammer for hammering stakes into a surface.

14 Claims, 5 Drawing Sheets

(56) References Cited

U.S. PATENT DOCUMENTS

| | | | | |
|---|---|---|---|---|
| 2013/0051707 | A1* | 2/2013 | Pisano | A45B 3/00 383/75 |
| 2014/0041703 | A1 | 2/2014 | Funston | |
| 2019/0059318 | A1 | 2/2019 | Hanson | |
| 2019/0216187 | A1* | 7/2019 | Van Vollenhoven | A45B 25/22 |

OTHER PUBLICATIONS

ScreenShot of Summer Large Canopy Sand Bags Blue Sand Bags Weights Portable Weights for Canopy Legs Beach Umbrella Sand Bag Heavy Duty Sandbag for Tent Outdoor Instant Canopies Holiday Supplies (2 Pieces) (https://www. amazon.com/Weights-Portable-Umbrella-Canopies-Supplies/dp/B09S346V25/ref=sr_1_7?hvadid=657208735389&hvdev=c&hvlocphy=9011707&hvnet . . . ); 1 page; retrieved Jul. 12, 2022.

Neso 1 Sunshade (https://www.rei.com/product/123573/neso-1-sunshade?sku=1235730002&store=256&cm_mmc=PLA_Google%7C21700000001700551_1235730002%7C9270005 . . . ); 12 pages; retrieved May 10, 2023.

* cited by examiner

ANCHORING SYSTEM FOR UMBRELLA

BACKGROUND

Beach umbrellas and the like are commonly use to provide shade. A common problem is that the wind can blow over the umbrellas.

Information regarding beach umbrellas can be found in references cited in an Information Disclosure Statement, including: US patent publications 2011305867; 2014041703; and 2019059318

Despite previous efforts for securely anchoring umbrellas such as beach umbrellas, there remains a need for an anchoring system for umbrellas that is versatile, easy to use, and easy for storage.

SUMMARY

An umbrella according to the present invention that satisfies this need comprises a canopy, a pole, and a plurality of pouches suitable for holding ground material such as sand, rocks or dirt. The umbrella includes a cord for each pouch for linking the pouch to the canopy, and hook and loop fastener pairs for removably attaching each pouch to the canopy, wherein one of the pairs is secured to the pouch and the other pair is secured to the canopy. To anchor the erect umbrella the pouches with grounding material therein are buried in a ground surface.

Optionally each pouch has a loop for receiving a stake for staking the umbrella to a surface as an optional way of anchoring the umbrella.

Typically, the pole has a bottom section and a hollow section at the bottom section, with the umbrella having a removable cap on the bottom of the pole. The pole can contain a stake in the hollow section for each pouch.

The cap can comprise an integral hammer that is in the hollow section, wherein the hammer can be used for hammering stakes in place.

The cap can be threaded onto the bottom of the pole where the pole has a corresponding thread. Optionally for retrofitting an existing umbrella an adapter can be provided for connecting the cap to the bottom section of the pole. The adapter has first and second opposed end sections, wherein the first end section of the adapter is fitted onto the bottom section of the pole and the cap is threaded to the second end section of the adapter.

Typically, the hook and loop fastener pairs are secured to the canopy equidistantly spaced apart from each other.

Not all of these features need to be used together. For example, stakes being within the pole can be used without other features such as removeable pouches. Likewise, a cap with an integral hammer for hammering in stakes can be used without other features of the invention.

In a method of using the umbrella for staking the umbrella to a ground surface, the cap, including the hammer, can be removed from the pole and at least one stake is withdrawn from the pole. Then the stake is pounded into the ground surface with the hammer.

In another method of anchoring an umbrella, the pouches are removed from the canopy, the umbrella is erected, and the pouches are at least partially filled with a grounding material. Thereafter, the pouches are buried in a ground surface.

DRAWINGS

These and other features, aspects, and advantages of the present invention will become better understood with regard to the following description, the following claims and the accompanying drawings where:

DESCRIPTION

With reference to the figures, an umbrella 10 comprises a canopy 12 supported by a pole 14. A collapsible framework (not shown) is used for supporting the canopy 12 on the pole 14 for raising and lowering the canopy 12. The canopy 12 as shown in the figures is in a up position, and can be collapsed into a down storage position (not shown).

Figure 2:
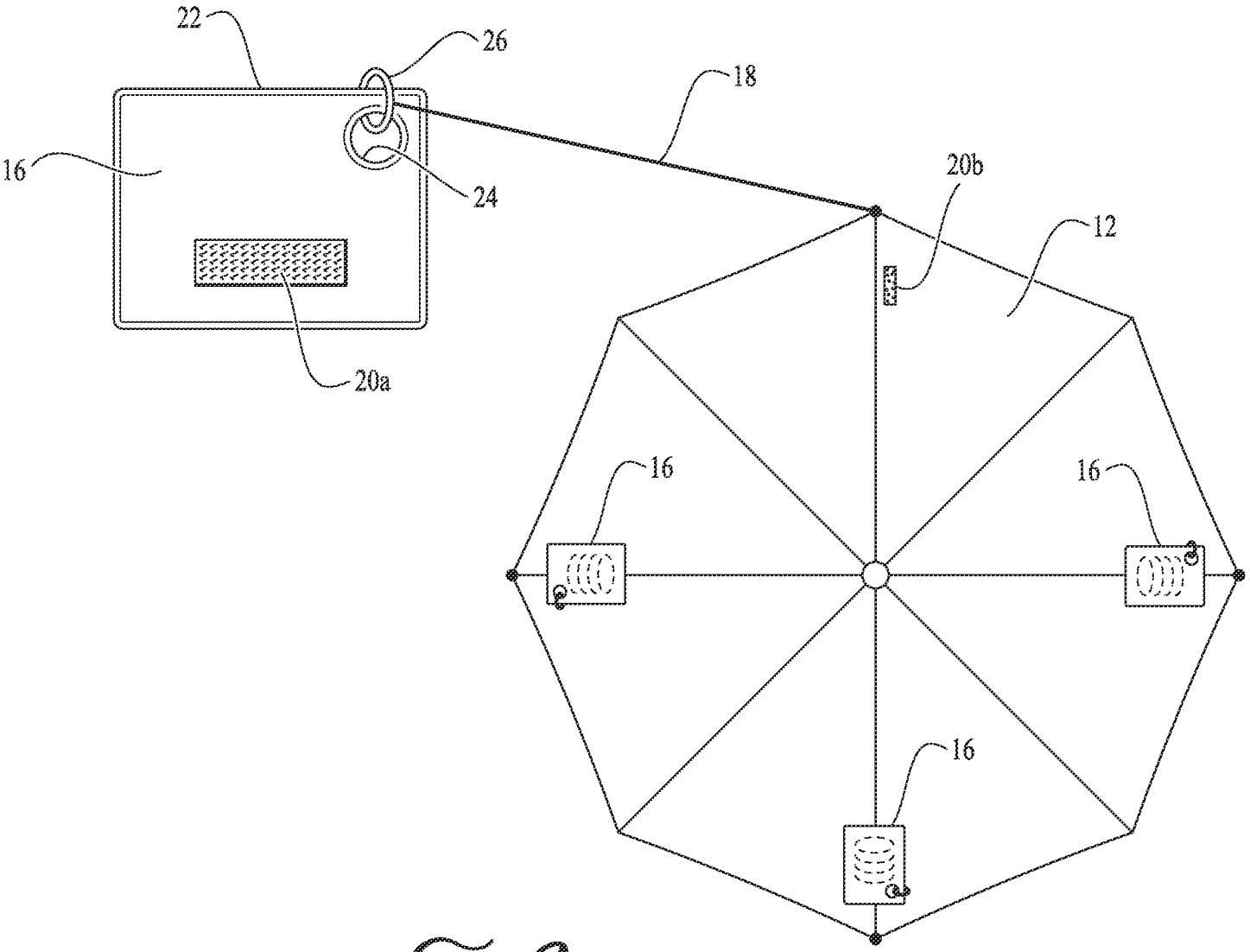
FIG. 2 is a top plan view of the umbrella of FIG. 1 showing a pouch extending from the umbrella.

There is a plurality of pouches 16, and as shown in FIG. 2, there can be four pouches 16 equidistantly spaced from each other in a storage position (one of the pouches is exploded out and not shown secured to the canopy 12). Each pouch 16 is secured to the umbrella canopy 12 with a cord 18 for each pouch. The cord 18 can be fabricated from any suitable flexible material such as string, rope, or chain.

Hook and loop fasteners, such as Velcro (trademark), are provided for removably attaching each pouch 16 to the canopy 12. The hook and loop fasteners comprise first and second components 20*a* and 20*b*, where the first component 20*a* has tiny hooks and the second component 20*b* has small loops. The hook component can be attached to the pouches with the loop component attached to the canopy as shown in FIG. 2, or vice versa. As shown in FIG. 2, the pouches can be stored by being secured to the canopy using the hook and loop fasteners, and then can be easily removed when the pouch is to be used for anchoring.

Figure 1:
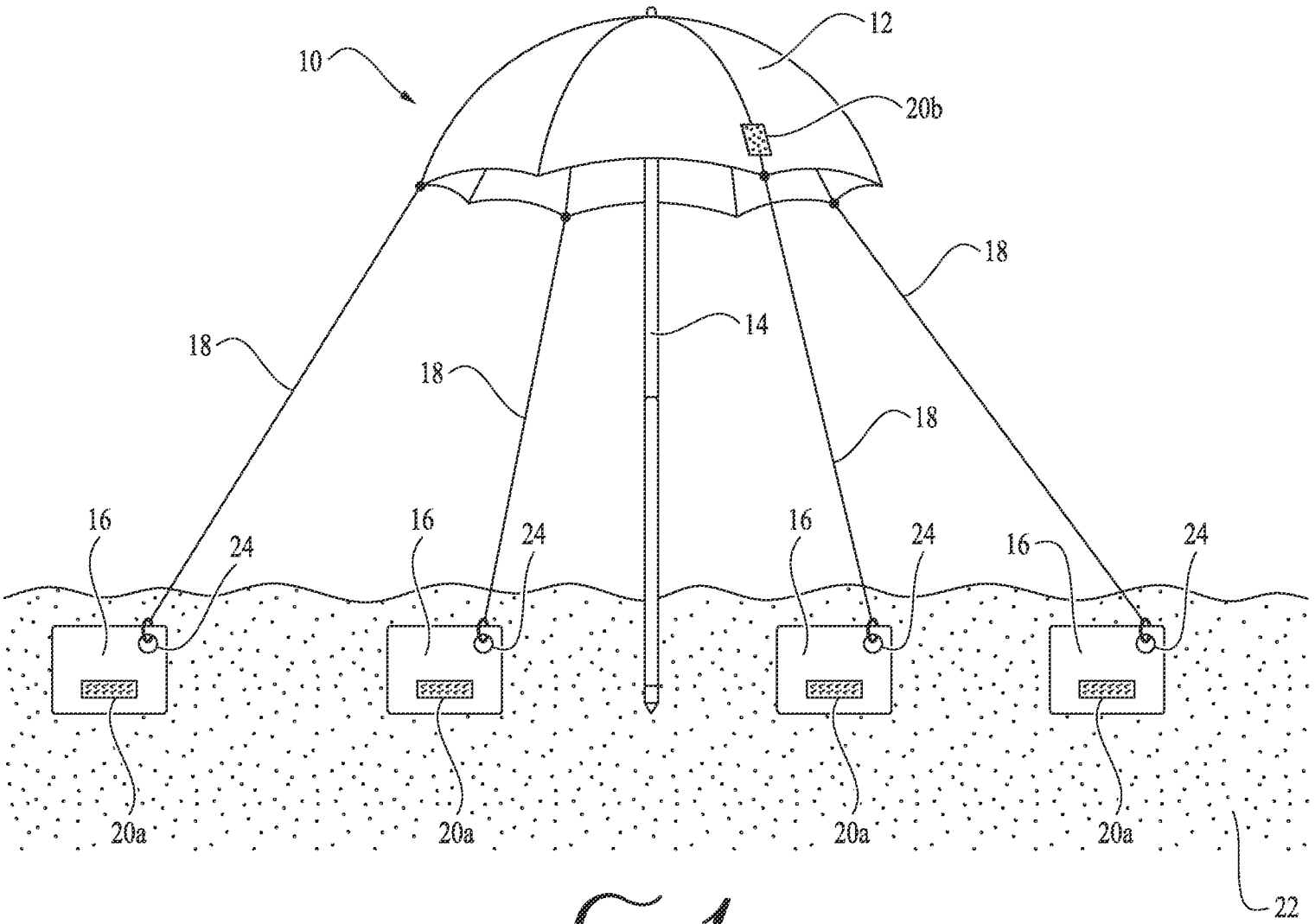
FIG. 1 is a front elevation view of an umbrella having features of the present invention mounted in sand.

The pouches 16 have an opening such as an open edge 22 so they can be filled with a grounding material for anchoring the umbrella. The grounding material can be any material providing sufficient weight for grounding. Exemplary grounding materials are dirt, stones, metal fillings, metal balls, or any combination thereof. As shown in FIG. 1, the pouches can be buried such as in sand 22.

The cord 18 is attached to each respective pouch 16 through an eyelet 24, wherein the cord is threaded through the eyelet 24 and tied to itself, and the length of the cord 18 can be adjusted as needed.

Optionally a ring 26 can be in the eyelet 24 and the cord 18 can be adjustably connected to the ring 26 so the length of the cord can be adjusted.

Figure 5:
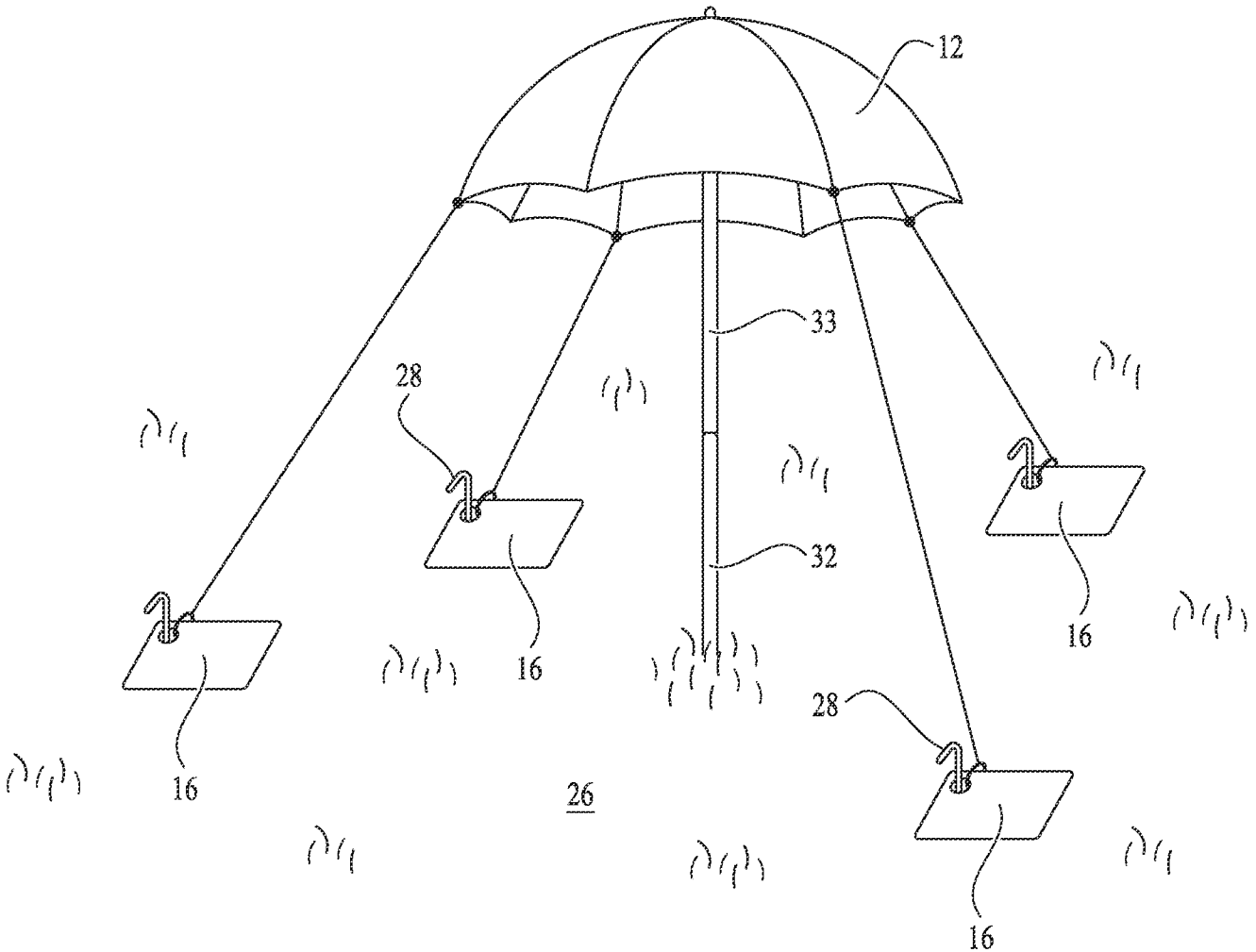
FIG. 5 is a front elevation of the umbrella of FIG. 1 mounted on grass.

As shown in FIG. 5, when the umbrella 10 is used with a relatively solid ground surface 26 where it would be requiring digging too bury the pouches, the pouches can be staked in place by use of stakes 28 that can extend through the eyelet 24 into the ground surface 26. The stakes have a pointed end 30 for penetrating a ground surface and a hooked end 31*a* for being securely placed in the eyelet 24. Optionally an additional eyelet (not shown) can be used just for the stakes rather than using a single eyelet for attaching both the cord and used for stakes.

The pole 14 comprises a bottom section 32 and a top section 33, wherein there is a hollow section 34 in the bottom section 32 of the pole 14.

Figure 3:
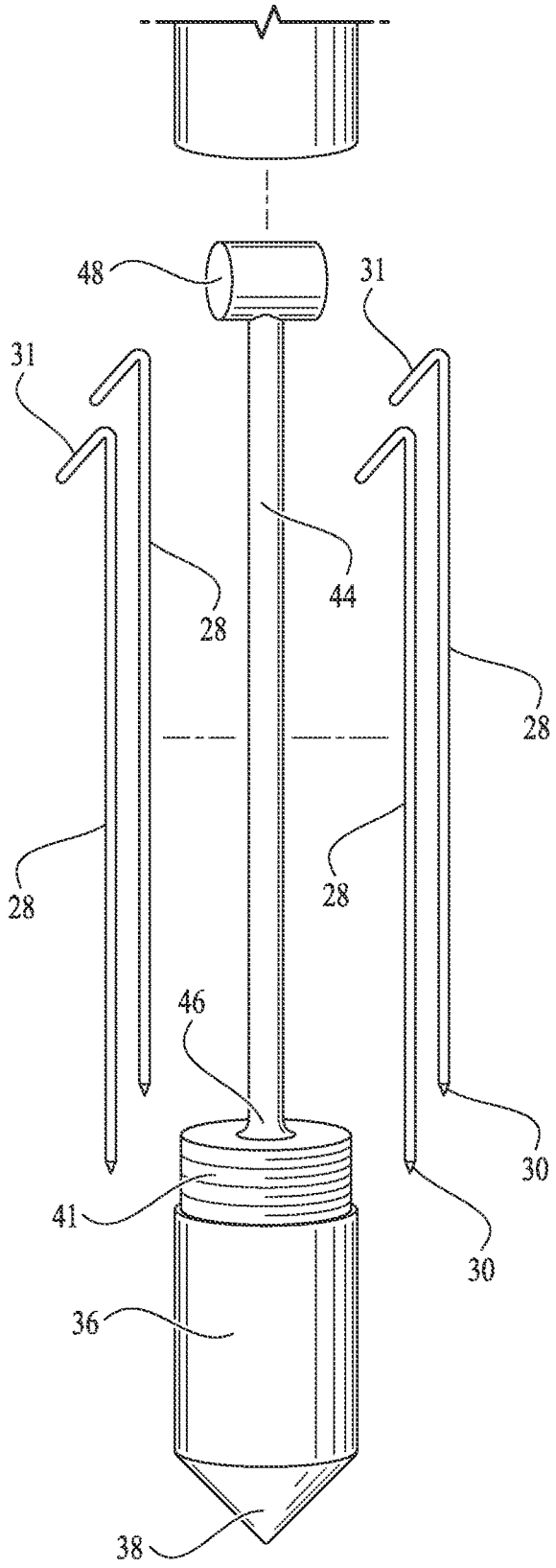
FIG. 3 is a perspective view of the bottom cap of the pole of the umbrella of FIG. 1 with an incorporated hammer.
Figure 4:
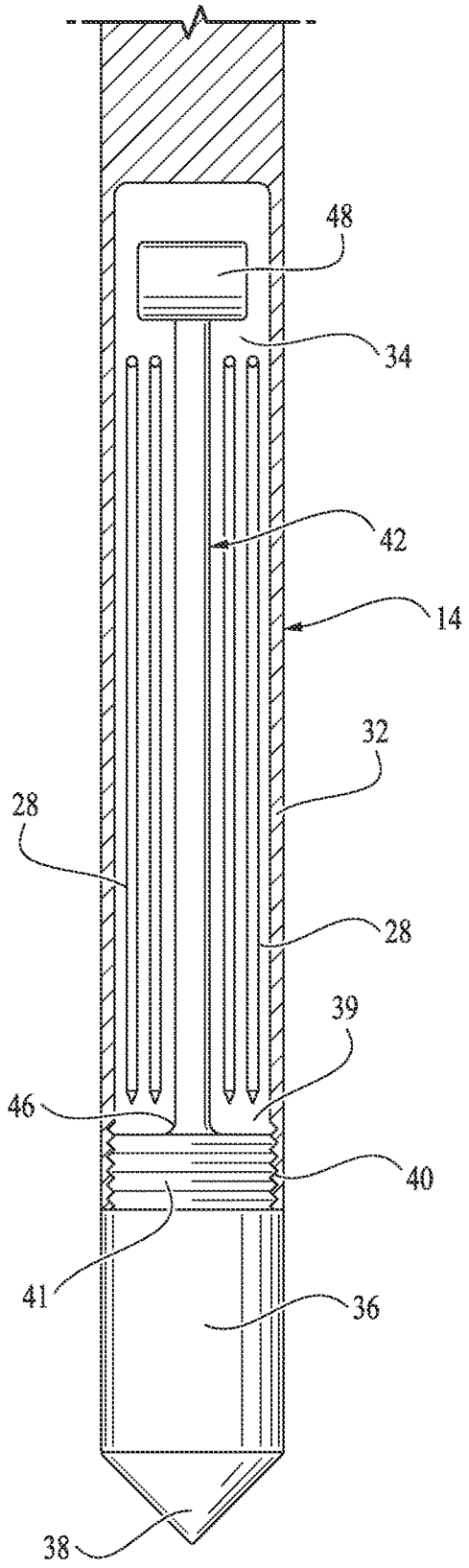
FIG. 4 is a longitudinal sectional view of the pole of the umbrella of FIG. 1 showing stakes and the hammer inside the pole.

The umbrella 10 comprises a cap 36, which in the version shown in FIGS. 3 and 4, is threaded onto the bottom section. The cap 36 has a pointed end 36*a* for engaging the ground surface 26.

The stakes 28 can be stored in the hollow section 34 as shown in FIG. 4 when the umbrella 10 is not in use, i.e. in a storage position.

The bottom section 32 has at its bottom end 39 threads 40 corresponding to and for engaging threads 41 on the cap.

The cap 36 can comprise an integral hammer 42 which comprises a shaft 44 with a first end 46 of the shaft attached to the cap 38 and an opposed second end comprising a hammer head 48. The hammer 42 extends into the hollow section 34 of the pole 14.

For clarity, any of the following features can be used independently or any combination with the other features.

a. Removably attached pouches
b. Stakes stored in the pole; and
c. A hammer integral with the cap in a storable hollow section 34 of the pole 14.

Figure 6:
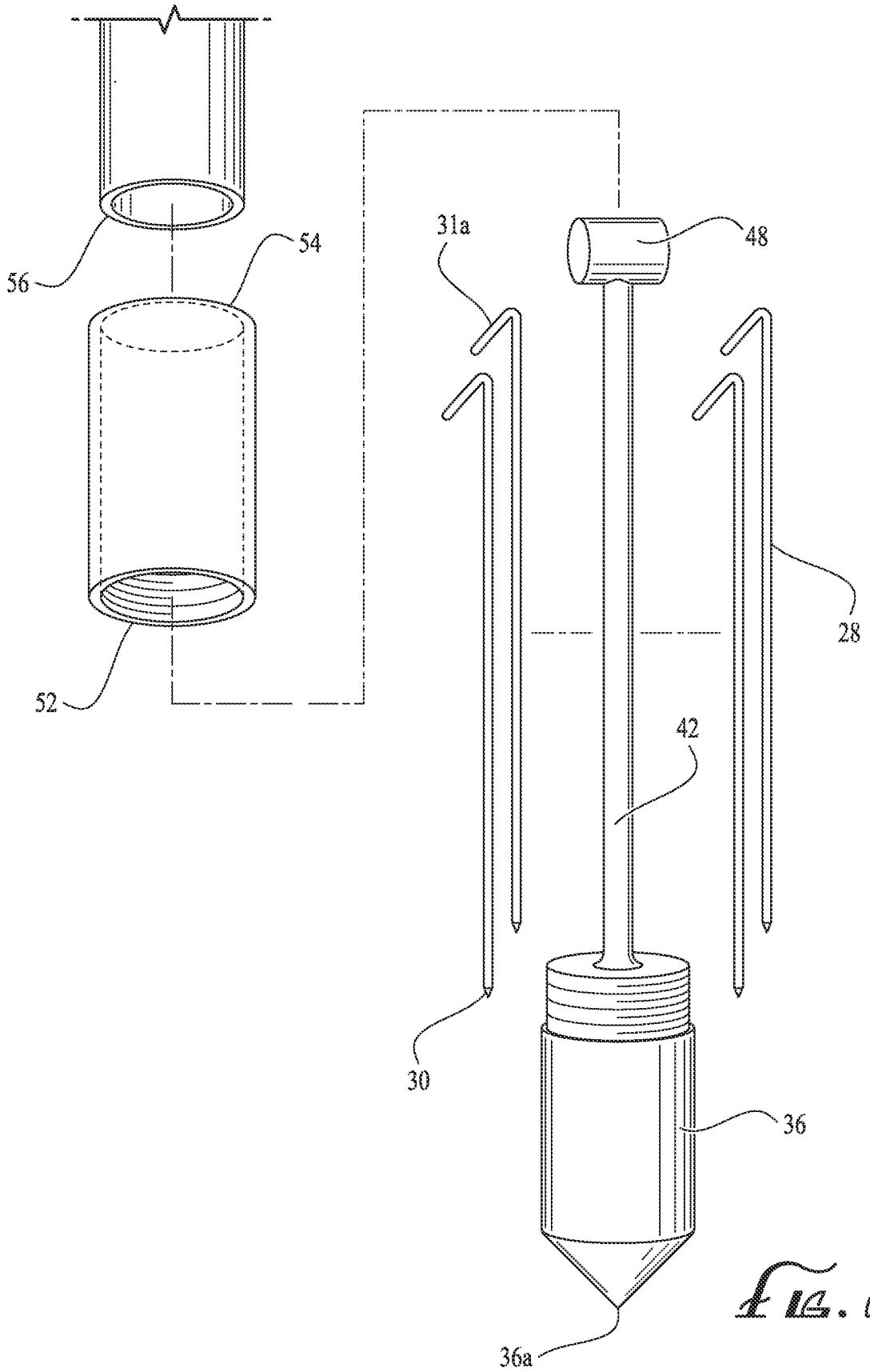
FIG. 6 shows an umbrella having features of the present invention with use of an adapter for securing the bottom cap to the pole.

In the version of the invention shown in FIG. 6, where the bottom of the pole does not have threads for engaging the cap 36, an adapter 50 can be provided, the adapter having opposed first and second ends 52 and 54. The first end 52 is threaded for receiving the threaded portion of the cap 36. The second end 54 engages the bottom of the pole 14 such as sliding onto or into pole for removable attachment to the pole. Alternatively, the adapter 50 can be permanently placed on the pole such as by a compression fit or use of an adhesive, or a plastic can be suitably softened by softening the plastic, placing it on the pole, and letting the softened plastic harden.

To use the invention as shown in FIG. 1, the pouches 16 are removed from the canopy, the umbrella is erected with the pointed end of the pole extending into a ground surface, the pouches 16 are at least partially filled with grounding material, and then buried in ground level, thereby anchoring the umbrella in an erect position.

In the version of the invention as used and shown in FIG. 5, the pouches are removed from the canopy, the cap 36 is removed from the pole 14, stakes 28 are removed from the pole and placed into an opening in the pouches with the hook end of the stakes extending upwardly, and then the stakes are pounded or hammered into a ground surface with the hammer.

Among the advantages of this invention are that it is versatile, easy to use, and easy for storage.

Although the present invention has been described in considerable detail with reference to certain preferred versions, there are other versions possible. For example, the stakes need not be stored in the pole, but can be removable secured to the outside of the pole. Therefore the scope of the following claims should not be limited to the description of the preferred versions thereof.

What is claimed is:

1. An umbrella comprising:

a. a canopy;
b. a pole, the pole having a bottom section and a hollow section in the bottom section;
c. a plurality of pouches suitable for holding grounding material;
d. a cord for each pouch for linking the pouch to the canopy; and
e. a removable cap on the bottom section of the pole, the cap comprising an integral hammer in the hollow section; and
f. hook and loop fastener pairs for removably attaching each pouch to the canopy, one of the pairs secured to the pouch and the other of the pairs secured to the canopy.

2. The umbrella of claim 1 wherein each pouch has a loop for receiving a stake for staking the umbrella to a surface.

3. The umbrella of claim 1 wherein the cap is threaded onto the bottom section of the pole.

4. The umbrella of claim 1 comprising an adapter for connecting the cap to the bottom section of the pole.

5. The umbrella of claim 4 wherein the adapter has opposed first and second end sections, wherein the first end section is fitted to the bottom section of the pole and the cap is threaded to the second end section of the adapter.

6. The umbrella of claim 1 wherein the hook and loop fastener pairs secured to the canopy are equidistantly spaced apart from each other.

7. A method for securing the umbrella of claim 1 to a ground surface, wherein the pouches are removably attached to the canopy, the method comprising the steps of:

a. removing the cap, including the hammer, from the pole;
b. removing the pouches from the canopy before or after step (a);
c. after step (a) and before or after step (b), withdrawing stakes from the pole; and
d. pounding the removed stakes into the ground surface with the hammer.

8. A method for anchoring the umbrella of claim 1 the method comprising the steps of:

a. removing the pouches from the canopy;
b. erecting the umbrella;
c. filling the pouches at partially with a grounding material; and
d. after steps (b) and (c), burying the pouches in a ground surface.

9. An umbrella comprising a pole having a bottom section and a hollow section in the bottom section, the umbrella comprising a removable cap on the bottom section of the pole, and the pole storing a plurality of stakes in the hollow section for grounding the umbrella, wherein the cap comprises an integral hammer extending into the hollow section.

10. A method for staking the umbrella of claim 9 to a ground surface, the method comprising the steps of:

a. removing the cap, including the hammer, from the pole;
b. withdrawing at least one stake from pole; and
c. pounding the stake into the ground surface with the hammer.

11. An umbrella comprising a pole having a bottom section and a hollow section in the bottom section, the umbrella comprising a removable cap on the bottom section of the pole, the cap comprising an integral hammer in the hollow section.

12. The umbrella of claim 11 wherein the hammer is integral to the cap so that the hammer is available when the cap is removed from pole for hammering stakes into a ground surface.

13. A method for staking the umbrella of claim 11 to a ground surface, the method comprising the steps of:

a. removing the cap, including the hammer, from the pole; and
b. pounding a stake into the ground surface with the hammer.

14. An umbrella comprising a pole having a bottom section and a hollow section in the bottom section, the umbrella comprising a removable cap at the bottom section of the pole, and a hammer wherein the cap comprises an integral hammer extending into the hollow section.

* * * * *